US007225743B2

(12) United States Patent
Schlienger

(10) Patent No.: US 7,225,743 B2
(45) Date of Patent: Jun. 5, 2007

(54) ELEVATED RAIL TRANSPORTATION SYSTEM

(75) Inventor: Max P. Schlienger, Ukiah, CA (US)

(73) Assignee: Flight Rail Corporation, Ukiah, CA (US)

( * ) Notice: Subject to any disclaimer, the term of this patent is extended or adjusted under 35 U.S.C. 154(b) by 0 days.

(21) Appl. No.: 10/860,861

(22) Filed: Jun. 4, 2004

(65) Prior Publication Data

US 2004/0244635 A1 Dec. 9, 2004

Related U.S. Application Data

(60) Provisional application No. 60/476,486, filed on Jun. 5, 2003.

(51) Int. Cl.
*B61B 13/00* (2006.01)

(52) U.S. Cl. ..... 104/155

(58) Field of Classification Search ..... 104/155, 104/156, 157, 158, 159
See application file for complete search history.

(56) References Cited

U.S. PATENT DOCUMENTS

| | | | | |
|---|---|---|---|---|
| 4,017,039 | A * | 4/1977 | Carstens | 406/105 |
| 4,520,733 | A * | 6/1985 | Willmann | 104/93 |
| 5,460,098 | A * | 10/1995 | Jackson et al. | 104/23.2 |
| 6,178,892 | B1 * | 1/2001 | Harding | 104/155 |
| 6,213,026 | B1 * | 4/2001 | Coester et al. | 104/155 |

* cited by examiner

*Primary Examiner*—S. Joseph Morano
*Assistant Examiner*—Robert J. McCarry, Jr.
(74) *Attorney, Agent, or Firm*—Townsend & Townsend & Crew LLP

(57) ABSTRACT

A system for propelling a vehicle along an elevated, pneumatic power tube carried by exterior support structure above ground. First and second angles define tracks for the vehicle and extend parallel to the power tube. Undercarriages secured to the vehicle including vehicle support and guidance wheels which are rotatable about axes inclined relative to legs of the angle tracks have a periphery that engages the legs of the angle tracks so that the weight of the vehicle is supported by the tracks and the support structure only. A pneumatic propulsion unit is movably disposed inside the power tube and is guided along rails on the inside of the power tube. A magnetic coupler having first and second cooperating magnetic elements is attached to the vehicle and the propulsion unit in operative alignment with each other. A portion of the power tube located between the magnetic elements is constructed of a non-magnetic and non-conductive material and extends over the length of the power tube. The propulsion unit has a thrust carriage with a thrust valve that forms a collapsible, frusto-conically shaped wall formed by a multiplicity of overlapping, angularly inclined blades that are concentrically disposed in the power tube. An actuator is coupled to the blades for selectively increasing an angle of the blades until free ends thereof contact an interior surface of the power tube, to thereby prevent the flow of air through the tube past the wall, and for retracting the blades so that the free ends thereof are spaced apart from the interior surface of the power tube, the valve generating a force acting in the longitudinal direction of the power tube when the free ends of the valve blades engage the interior surface.

18 Claims, 6 Drawing Sheets

ELEVATED RAIL TRANSPORTATION SYSTEM

CROSS-REFERENCES TO RELATED APPLICATIONS

This application claims the priority and is a continuation of U.S. provisional patent application No. 60/476,486 filed Jun. 5, 2003.

BACKGROUND OF THE INVENTION

Rapid mass ground transportation systems offer many benefits over non-mass transportation means such as the use of automobiles, particularly in metropolitan areas experiencing severe traffic congestion and pollution problems. Mass ground transportation may also be a desirable alternative for short-range as well as long-range air travel. Although there has been a general recognition of the need for a reliable, safe rapid transportation system, utilization of rapid transit systems has been hindered by the high cost of construction and operation as well as technical difficulties in developing an efficient and versatile light rail system.

Conventional approaches have not produced a light rail transportation system that is sufficiently versatile, efficient and cost-effective to be a feasible substitute for non-mass transportation and air travel alternatives. For instance, some so-called light rail systems have rather heavy transportation modules due to the use of heavy undercarriage or a heavy power system, high traction requirements, high on-board fuel requirements, or the like. Systems that rely on traction drives tend to have difficulty with steep grades. Moreover, external elements such as severe weather conditions and contaminations can pose substantial difficulty in the operation and maintenance of light rail systems. Additionally, traction drive mechanisms employing wheels tend to produce a lot of noise as well as wear.

The present inventor's U.S. Pat. No. 6,360,670 B1, which is incorporated herein by reference, overcomes some of these difficulties and disadvantages in an efficient and cost-effective light rail transportation system that uses a guideway system that does not depend on traction for movement. In a specific embodiment disclosed in that patent, the pod assembly is placed inside a guide tube, the exterior of which preferably supports and guides the vehicle as it moves along the tube. Motion is generated by providing a pressure differential inside the tube between the upstream region and the downstream region of the pod assembly. The pressure differential can be generated by a stationary power system that produces a vacuum on the downstream region or pressurizes the upstream region or both. The speed of the pod assembly is controlled by modulating the amount of gas flow through the pod, that is, from the upstream side to the downstream side of the pod. The speed of the pod assembly is increased by reducing the amount of gas flow through the pod assembly to thereby increase the thrust on it, and is decreased by permitting a larger amount of gas to flow past the pod assembly to decrease the thrust.

Because the thrust required to move the pod assembly is generated by stationary power systems, the vehicle does not require heavy on-board engines or drive trains. The pod assembly and guide tube are relatively light in weight and are well-suited for use in a light rail system. The guide tube can be elevated because of the light overall weight of the system, reducing right-of-way costs. When elevated, grading costs and requirements are significantly reduced.

In that earlier patent, a magnetic coupling apparatus is used to couple the pod assembly inside the guide tube with the transportation module outside the guide tube. The use of a magnetic coupling apparatus eliminates the need to mechanically connect the pod assembly and the transportation module with a strut that would otherwise have to extend through a longitudinal opening in the wall of the guide tube. This allows the interior of the guide tube to be a closed system and avoids the need for a seal assembly for maintaining a desired pressure differential in the guide tube as the strut moves through the longitudinal opening of the guide tube, thereby improving mechanical integrity and pressure integrity of the system. Moreover, the use of the magnetic coupling apparatus instead of a mechanical coupling device makes it easier to clean the exterior of the guide tube and coupling apparatus or clear those areas of debris such as the removal of ice and snow. Magnetic coupling also allows disengagement of the pod assembly and transportation module without any mechanical linkage or disengagement. Because the transportation module is supported by the exterior surface of the guide tube, the weight of the transportation module is not carried by the pod assembly.

Although the transportation systems disclosed in U.S. Pat. No. 6,360,670 B1, as well as in related U.S. Pat. No. 6,279,485 and in U.S. Pat. No. 6,267,058, which is also incorporated herein by reference, provide important advances for elevated rail transportation technology, actual tests and theoretical evaluations have shown that some of the components of the system which is the subject of these earlier U.S. patents have certain disadvantages such as, for example, excessive wear or friction, maintenance problems, and the like. The present invention seeks to overcome these disadvantages and provides the improvements discussed below.

BRIEF SUMMARY OF THE INVENTION

A first aspect of the invention improves the elevated, tubular guidance and power track by providing interior rails for the main thrust or propulsion unit, also sometimes referred to as otter assembly. The interior rails preferably are round metal, e.g. steel, bars arranged in substantial alignment with a horizontal center line of the power tube that are engaged by grooved wheels of the unit, thereby leaving a bottom of the power tube clear of obstructions. This facilitates the cleaning of the interior of the power tube, including, when necessary, the intermittent removal of substances such as water, lubricants and/or debris that may accumulate at the bottom thereof. It further facilitates making needed vacuum and/or pressure connections from the exterior to the interior of the tube, mounting and maintaining isolation valves, and the like. Moreover, by mounting the thrust unit on wheels inside the tube, wear, as encountered with the tubular thrust pods employed in the system described in the above-referenced patents, is greatly reduced if not eliminated. Additionally, the interior rails strengthen the power tube and render it more rigid, which permits the tubes to be made lighter, thereby saving costs.

On the exterior, the power tube carries guidance and support tracks for a transportation module, such as a passenger cabin or cargo wagon, in the form of conventional, 90° metal angles made of steel or similar high strength materials, which are directly mounted to the ground-based support structure for the power tube. As a result, the power tube need not carry the weight of the transportation module.

Moreover, the right-angled track greatly simplifies guiding the module as it travels along the power tube, as is further described below.

Another aspect of the present invention relates to the configuration and functioning of the propulsion unit. It employs a generally horizontally oriented thrust carriage that is disposed in a horizontal mid-portion of the power tube and includes horizontal, V-grooved wheels that engage and run along the interior rails of the power tube for guidance and weight support. In a preferred embodiment, the thrust carriage has two wheels engaging one of the interior rails and a single wheel, disposed midway between the two wheels, which is spring-biased into engagement with the other interior rail of the power tube. Although this arrangement is preferred, if desired, the two spring-biased wheels can be provided as well. A generally fan-shaped thrust valve defined by a multiplicity of thrust blades arranged in an umbrella-like fashion, also sometimes referred to as "turkey valve" because of its fan-shaped configuration, is attached to the carriage of the propulsion unit and extends therefrom in the travel direction of the unit. Since such fan-shaped thrust valves are much more effective in one direction than the other, as is further described below, the interior carriage preferably has two such valves, one extending in each travel direction from the carriage to provide full thrust for the propulsion unit in either direction.

The carriage additionally mounts a magnetic coupler for interacting with a corresponding magnetic coupler carried by the transportation module. Since the interior rails engaged by the grooved wheels of the carriage assembly provide highly accurate guidance for the carriage and, therefore, maintain it in the desired position relative to the tube during standstill as well as travel, the stand-off, or spacing, between the active components of the magnetic coupler and the power tube can be minimized. This in turn enhances the effectiveness of the magnetic coupler.

The construction of the earlier mentioned turkey valve is a further aspect of the present invention. It has multiple, fan-shaped, tapered, elongated feathers or thrust blades, the small ends of which are attached to a rigid, cup-shaped body of the valve that is connected to the carriage of the propulsion unit so that the free ends of the blades extend past the open end of the cup. Suitable linear actuators, such as hydraulic, pneumatic, magnetic or mechanical (e.g. gear) actuators, extend the thrust blades out of or retract them into the cup-shaped body. In this manner, the free ends of the blades can be radially expanded into or out of contact with the interior surface of the power tube. When extended and in engagement with the power tube wall, the extended blades form an umbrella-shaped wall (defining concave and convex wall surfaces) across the entire diameter of the power tube. As a result, when the air pressure on the concave side of this wall is greater than on the convex side, a thrust is generated that is transmitted via the thrust carriage and the magnetic coupler to the transportation vehicle on the outside of the power tube.

In a preferred embodiment of the invention, the thrust blades are made of a flexibly resilient metallic, e.g. wire, frame to which a plastic, e.g. neoprene, sheet is applied. When the blades are extended outwardly from the valve body, the free ends of the blades can be brought into contact with the interior of the power tube, while the blades together form a generally concave, frusto-conical surface in the thrust direction of the valve. Such blades are capable of operating at a pressure differential of up to about 30 psi and more which generates ample force for moving vehicles in a forward direction at maximum power and/or speed. By increasing or decreasing the diameter of the power tube and/or the air pressure applied to one side of the thrust valve, the overall power and/or speed that can be attained can be adjusted for the anticipated operating conditions. Power and speed can be modulated by energizing the linear activator for the valve to slightly retract the blades from their contact with the interior of the power tube to reduce the power and/or speed by permitting air to bypass the valve through the resulting annular gap between the power tube and the free (and partially extended) ends of the thrust blades and/or by changing the air pressure applied to the interior of the power tube.

Since the thrust blades of the turkey valve need not carry any weight, and they in turn are guided through the power tube by the carriage running along the interior tracks, a low-friction seal between the thrust blades and the power tube is formed and maintained as the vehicle travels along the tube. This reduces wear of both the thrust blade and the power tube. In addition, the provision of individual thrust blades makes it easier for the blades to adapt to and follow dimensional irregularities of the thrust tube while maintaining the desired seal to maximize the efficiency of the power transmission resulting from the pressure differential between the power side and the downstream side of the valve. The resilient flexibility of the individual blades allows them to conform themselves to slight dimensional and/or shape changes over the length of the power tube while maintaining the desired seal between the valve blades and the tube.

A still further aspect of the present invention relates to the support and guidance of the transportation vehicle. Instead of supporting and guiding it on the exterior of the power tube as suggested in the past, two spaced-apart, parallel tracks made of conventional 90° metal, e.g. steel, angles are attached to and carried by the ground-based support for the power tube. As a result, the weight of the transportation module does not have to be carried by the power tube, and power tube deflections under the vehicle, which could adversely affect the thrust generation by the propulsion unit, are prevented.

The upper end of the upright leg of the angle track preferably has a keeper rail, which extends toward the side of the track that is in contact with the wheels of the vehicle. It acts as a retainer that keeps the inclined wheels in the track without generating the friction as is encountered with conventional, rimmed (e.g. railway) wheels.

The wheels of the vehicle are inclined at a preferred angle of 45°. In this manner, the wheels are symmetric relative to the sides of the angle tracks. As a result, the wheels can be smooth and do not require the rims needed for conventional rails. This in turn eliminates differential speeds between different portions of the wheel and the track, thereby reducing wear as well as operational noise.

DETAILED DESCRIPTION OF THE INVENTION

Figure 1:
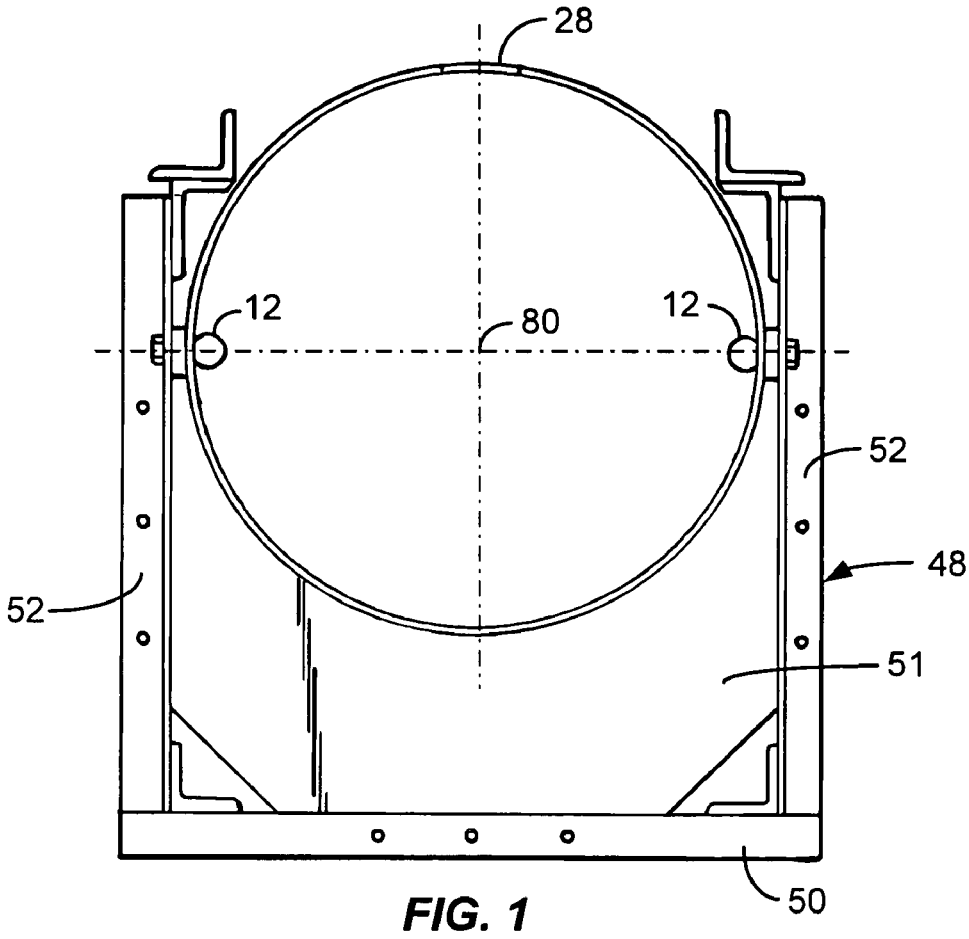
FIG. 1 is a cross-sectional, elevational view of an elevated rail transport system employing a power tube constructed in accordance with the present invention and provided with interior support rails and exterior vehicle tracks constructed in accordance with the invention.
Figure 1A:
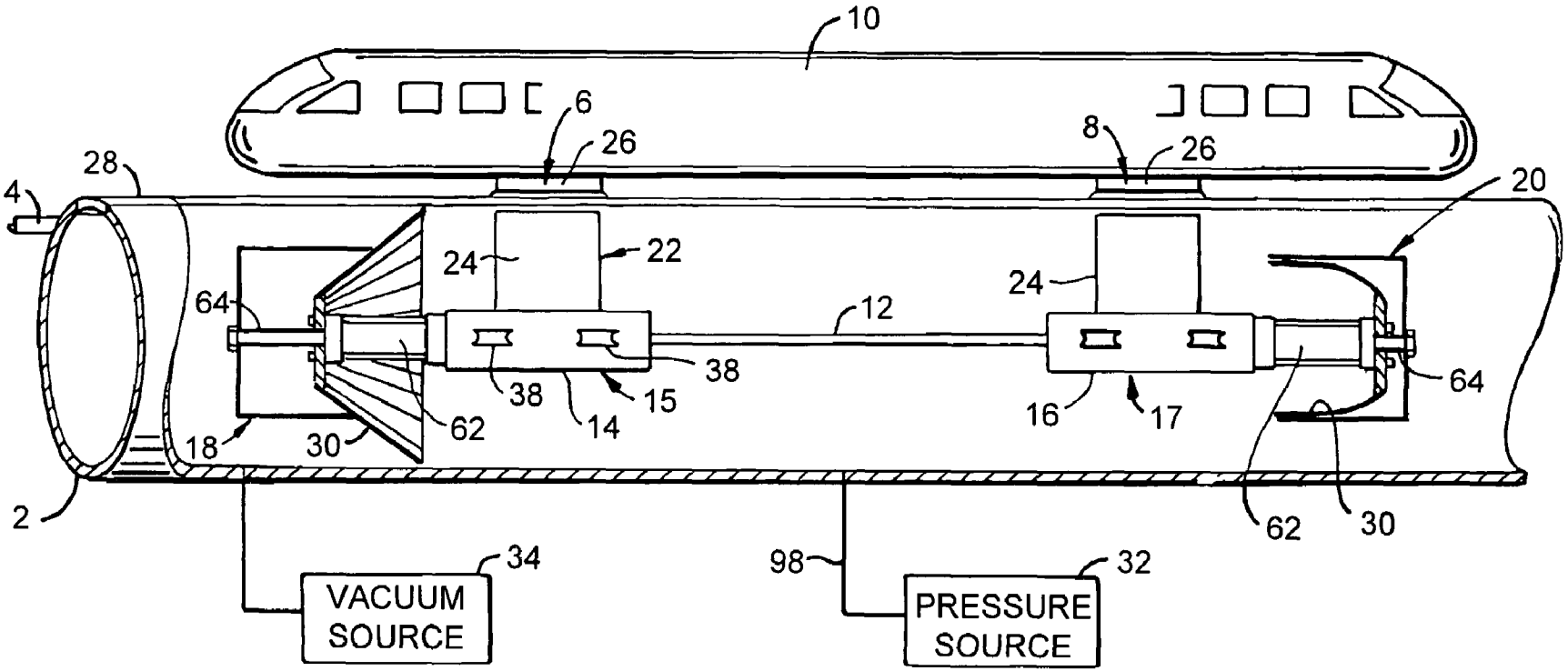
FIG. 1A is a fragmentary view, partially in section, and illustrates the overall arrangement and construction of the elevated rail transport system of the present invention.

Referring first to FIG. 1A, a light rail transportation system constructed in accordance with the present invention includes an elongated power tube 2 which is suitably supported above ground, as is further described below. On its lateral sides proximate the top of the tube are a pair of parallel, spaced-apart angle tracks 4, the included angle of which faces outwardly relative to the power tube in the preferred embodiment of the invention, and which receive, support and guide wheels (not separately shown in FIG. 1A) carried on spaced-apart, e.g. forward and aft, undercarriages 6, 8, which in turn support, carry and guide a transportation vehicle 10 such as an illustrated passenger cabin or cargo wagon (not shown).

Inside the power tube and preferably aligned with the horizontal axis of the tube are opposing interior rails 12, in the form of elongated round bars attached to the power tube which extend over its length. First and second propulsion units 15, 17 are disposed inside the power tube. Wheels 38 and 40 (not shown in FIG. 1A) engage the interior rails to support the carriage in a suspended position at about the center of the power tube and guide them as they move along the tube.

A thrust valve 18 is attached to each carriage and projects forwardly and rearwardly relative to the travel direction from power carriages 14, 16, respectively. When the thrust valve is in its expanded position (left-hand propulsion unit in FIG. 1A), it forms a valve wall 30 across the entire interior of the power tube. A positive pressure differential between the concave inner side (facing the associated power carriage) and the convex outer side (facing in the travel direction and away from the power carriage) of wall 30 provides the thrust or force which propels the power carriage in a forward direction. During this stage, the second thrust valve 20 attached to aft power carriage 16 is retracted so that the valve 18 does not resist movement of the carriage in the forward direction.

Vehicle 10, illustrated as a passenger-carrying cabin, is force-coupled to the forward and aft thrust carriages 14, 16 with magnetic couplers 22 defined by an inner magnetic element 24 carried by the respective carriages and an outer magnetic element 26 secured to the corresponding undercarriages 6, 8 for the cabin and aligned with the inner magnet element. Electric power is suitably applied to the magnetic coupler so that magnetic forces generated between the magnetic element force-couple the power carriages to the cabin undercarriages. For this purpose, a non-magnetic window strip 28 is part of and extends over the length of the power tube and defines the top portion of the tube.

In use, the cabin 10 and thrust carriages 14, 16 are aligned, and magnetic coupler 22 is energized to magnetically lock the carriages and the cabin to each other, thereby forming a unitary transportation module capable of traveling along level and inclined sections of the power tube. To initiate movement in the forward direction (to the left as seen in FIG. 1A), the forward thrust valve 18 is opened by expanding individual blades 86 of the thrust valve (further described below) so that they flare outwardly until their free, outer edges engage the interior wall of the power tube. Thereafter, air pressure from a source 32 applied to the interior of the power tube acts on the aft-facing surface of wall 30 of the opened forward thrust valve. The resulting pressure differential between the upstream and downstream sides of the valve generates a force which propels the transportation module in a forward direction. By increasing the pressure applied to the interior of the tube, the force generated by the power valve can be increased, thereby increasing the speed with which the power module travels along the power tube and/or enabling it to move along an upwardly inclined section of the power tube.

The force generated by the thrust valve can be enhanced by applying a vacuum to the interior of the tube forward of the power valve. In such an event, appropriate, remotely controlled switching is provided to sequentially activate and deactivate the pressure source and vacuum source as the valve travels along the power tube. Speed can further be modulated by slightly retracting wall 30 of the power valve, which permits some air to bypass the power valve and thereby decreases the forward acting force generated by the valve.

Movement of the transportation module can be reversed by expanding the aft thrust valve 20 and correspondingly retracting the front thrust valve 18. Activation of the aft thrust valve can also be used to assist in rapidly braking the module to slow it down and/or bring it to a standstill as it moves in the forward direction, which can include reversing the effective positions of the pressure and vacuum sources and their connections to the power tube.

Referring to FIGS. 1, 2, 5A and 5B, each of the power carriages 14, 16 of propulsion units 15, 17 is formed by a pair of spaced-apart, flat plates 36 which are suitably secured, e.g. bolted, together and are sized so that they span a substantial portion of the horizontal width of the power tube in its horizontal center but remain spaced from the power tube walls. A pair of spaced-apart, horizontally oriented V-grooved wheels 38 are rotatably journaled on one side and between plates 36. A third horizontal V-grooved wheel 40 is rotatably mounted at the side of carriage plates 36 opposite from wheels 38 on a lever 42, one end of which is pivotable about a pivot pin 44 and the other end is biased outwardly towards the inner wall of the power tube, preferably by a spring 46, but the other biasing devices such as pneumatically or magnetically powered pressure devices can be used if desired.

The power carriage is installed inside the power tube by initially compressing spring 46 to retract the V-grooved wheel 40. Wheels 38, 40 are horizontally aligned with interior rails 12 of the power tube. Spring 46 is then released, which biases wheel 40 carried on pivoting lever 42 outwardly, towards the wall of the power tube, until all three wheels engage the interior rails 12. Once installed, the wheels support the carriage on the interior rails and it can freely move along the interior rails. Since the third wheel 40 is spring-biased against the interior rail, slight dimensional variations or changes in the spacing between the interior rails are readily accommodated because spring 46 and lever 42 resiliently press the wheel outwardly against the rail.

Figure 2:
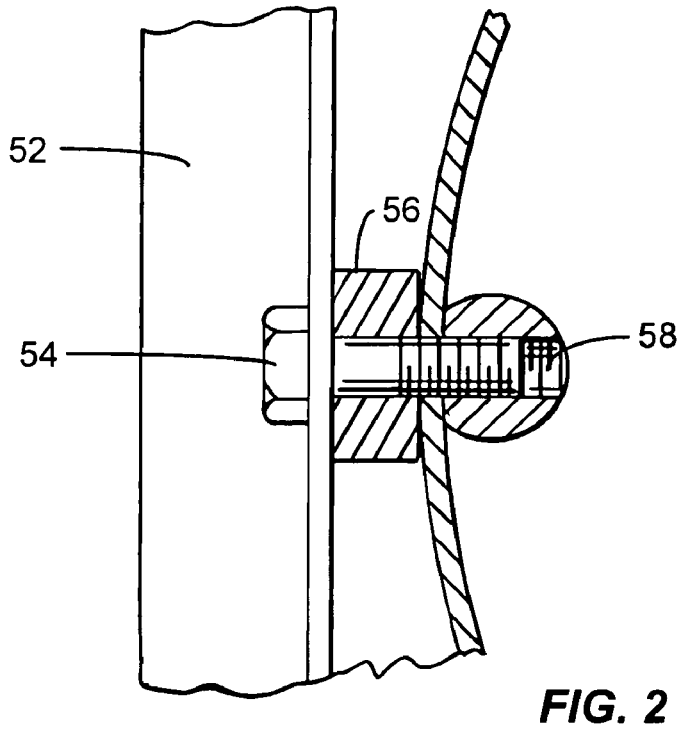
FIG. 2 is a fragmentary, enlarged cross-sectional view and shows the mounting of the interior rails to the interior of the power tube of the system.

As is best seen in FIGS. 1 and 2, power tube 2 is carried above ground by a support structure 48 in the form of intermittently spaced, upwardly open, generally U-shaped frames 50 which are conventionally anchored to the ground, e.g. with foundations built into the ground. The frame has uprights 52 which terminate short of, that is, below, the top of the power tube and above the bulkhead-like cradles 51 that extend to or slightly above the horizontal center line of the power tube and that secure and support a portion of the circumference of power tube 2.

The interior rails 12 can be attached directly to the inside of the tube, for example by welding them thereto. In a preferred embodiment, however, the interior rails are secured directly to uprights 52 of the support frame with bolts 54 that extend from the upright past bushings or spacers 56 and through holes in the power tube so that the bolts can be directly threaded into threaded bores 58 of the interior rails. To facilitate mounting of the interior rails and enhance their stability, the sides of the rails facing the interior wall of the power tube are flattened or contoured to conform to the curvature of the tube wall as is shown in FIG. 2. To prevent air leakage through the holes in the tube sealing washers, a sealing compound or the like is suitably applied to the holes.

Thus, in the preferred embodiment the interior rails 12 are firmly secured to frame uprights 52 to provide a rigid interior rail that supports and guides the grooved wheels 38, 40 of the thrust carriages 14, 16 as they travel over the length of the tube.

Figure 4A:
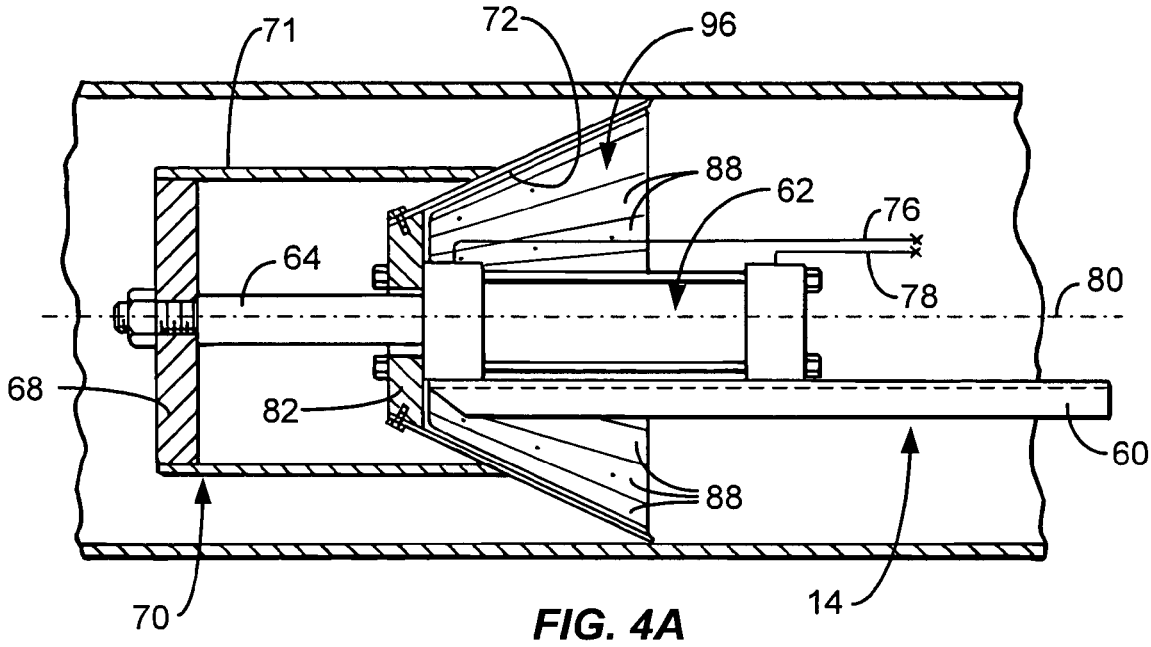
FIGS. 4A and 4B show the thrust valve of the present invention in its fully extended and retracted positions, respectively.
Figure 4B:
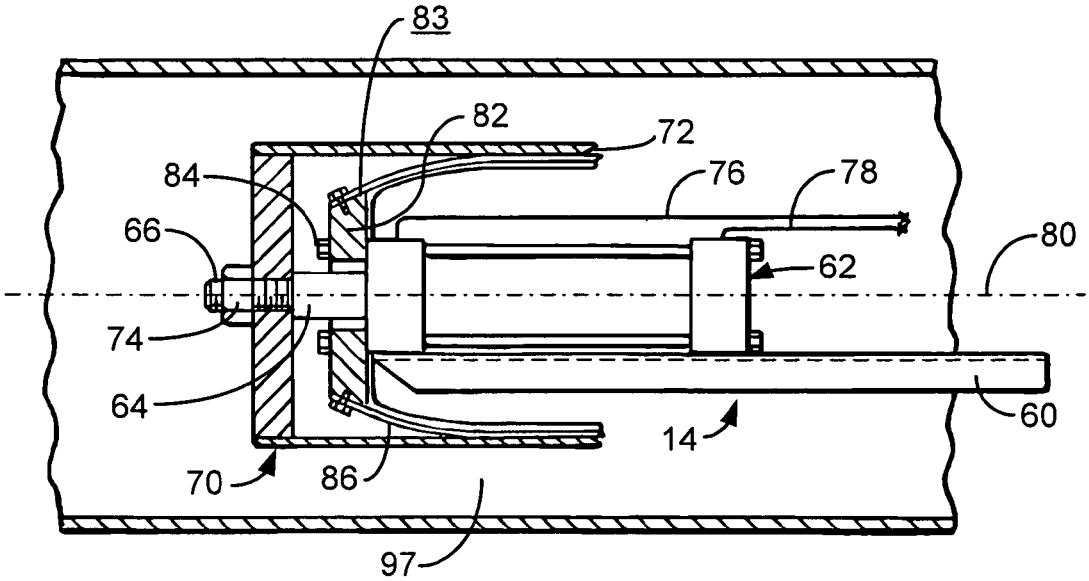

Referring to FIGS. 1A, 4A, 4B and 5A, 5B, thrust valves 18, 20 are attached to respective thrust carriages 14, 16. For that purpose, a mounting channel 60 is suitably secured to the under side of the lower plate 36 of the carriage so that it projects in the forward direction of carriage 14 (or rearward direction of carriage 16). A hydraulic actuator 62 is secured to the carriage; e.g. it is bolted to the mounting channel. Piston rod 64 of the actuator extends forwardly and has a threaded end 66 which extends through a bore in a base plate 68 of a cylindrical cup 70 that has walls which end in a tapered edge 72. Cup 70 is secured to piston rod 64 with a nut 74. Hydraulic feed and return lines 76, 78, remotely controlled from cabin 10, provide hydraulic actuating fluid to the actuator so that the piston can be extended forwardly (FIG. 4A) or retracted rearwardly (FIG. 4B). The hydraulic cylinder and cup 70 are coaxial with center line 80 of the power tube so that the valve can be expanded into uniform contact with the inner surface of the power tube.

A circular holding plate 82 is concentric with respect to hydraulic actuator 62, and bolts 84 suitably secure it to the actuator, or to any other available component of thrust carriage 14. The peripheral surface 83 of the holding plate is angularly inclined relative to center line 80 and converges in a forward direction. A plurality of fan-shaped blades or feathers 86 are attached to the peripheral surface of the holding plate, preferably with bolts, but rivets, welding them to the holding plate, or other suitable securing devices, including for example bonding materials, can be used if desired.

Figure 3:
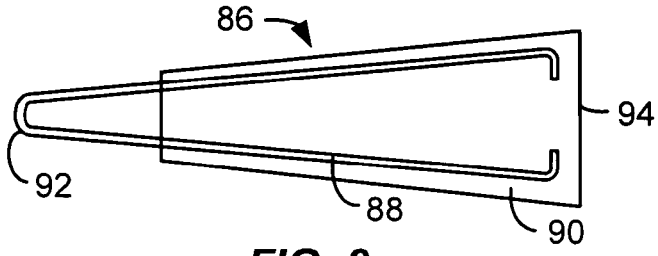
FIG. 3 is a plan view of a fan-shaped thrust blade employed in the thrust valve of the present invention.
Figure 3A:
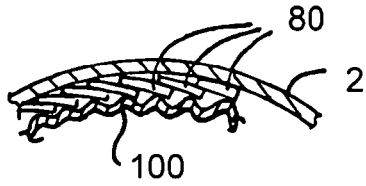
FIG. 3A is a fragmentary, sectional elevational view of a portion of the thrust or turkey valve of the present invention.

As is best seen in FIGS. 3 and 3A, each blade 86 is defined by a resiliently flexible, e.g. metal, wire or rod frame 88 to which a sheet 90 of an air-impervious material, such as plastic, neoprene or another material that has a relatively low coefficient of friction with respect to metal, is suitably secured, for example by bonding, welding or clamping. The blade frame 88, and therewith the entire blade 86, diverges from a narrow (forward) end 92 towards the other free (rear) end 94, which is substantially wider than the forward end. To enhance the formation of a seal between the blades and the power tube, the free ends 94 of the blades can be curved to conform them to the curvature of the tube.

A multiplicity of blades 88 are secured to holding plate 82 so that the blades, together, define the resilient outwardly diverging frusto-conical wall 30 having a convex front side facing in the travel direction of the propulsion unit and a correspondingly convex rear side facing in the opposite direction.

When hydraulic actuator 62 is in its retracted position (FIG. 4B), the cylindrical wall 71 of cup 70 resiliently compresses the blades radially inward (towards center line 80 of the power tube). As a result, a bypass channel 97 is formed between cup 70 and the surrounding power tube 2 through which air (or any other fluid medium) can freely pass so that no appreciable force can be generated by the valve.

When hydraulic actuator 62 is extended (FIG. 4A), cup 70 is moved forwardly (with respect to forward thrust carriage 14). As a result, blades 86 are free to expand outwardly as a result of the resiliency of blade frames 88 until the free, wide ends 94 of the blades extend at an inclined angle sufficiently radially outwardly that they engage the inside of power tube 2. A frusto-conical and somewhat resilient wall 96 is thereby formed that extends over the entire inside cross-section of the power tube and separates the aft side of the frusto-conical wall from the front side thereof. When there is a positive pressure differential between the aft and front sides of the frusto-conical wall, a force acts on the wall in a forward direction (to the left as seen in FIG. 4A), which is transmitted via holding plate 82 to thrust carriage 14 and provides the desired forward thrust for moving the carriage (and the cabin attached thereto) in a forward direction. The magnitude of the force generated thereby, and the resulting speed with which the carriage will move forward, is a function of the pressure differential between the two sides of the frusto-conical wall and the inclination, if any, of the power tube. The pressure differential can be modulated to increase or decrease the force as needed.

As is best seen in FIG. 4A, the tapered edge 72 at the end of cylindrical cup wall 71 provides support to the expanded valve blades and prevents them from bending or other deformation under pressure differentials. To provide good support, the diameter of cup wall 71 is about two-thirds of the diameter of the power tube.

The individual blades 86 flare outwardly from inner end 92 to outer end 94, and they are shaped so that when they are in their expanded position (FIG. 4A) they overlap each other to avoid gaps between them through which air could escape.

To further prevent air leakage past the overlapping blades 86 when they are in their expanded position, a frusto-conical skirt 100 made of a flexible material such as neoprene or other flexible plastic can be properly fitted and attached to the concave inside of the blades, as is shown in FIG. 3A, for example by attaching it to at least some of the overlapping blades. When the blades are in their retracted position, the skirt will fold, as is illustrated in FIG. 3A. Conversely, when the blades are fully expanded, the skirt has sufficient material to permit such a blade expansion. At the same time, the skirt provides additional sealing to more positively prevent leakage of air between the overlapping blades.

In use, when it is desired to move the power carriage in a forward direction (to the left as seen in FIG. 4A), piston rod 64 is extended until the free ends 94 of blades 86 sealingly contact the inner wall of power tube 2. Air pressure is then applied to the back side of the frusto-conical wall formed by the blades to generate the force that propels the thrust valve, the thrust carriage 14 attached thereto, and cabin 10 coupled to the carriages in a forward direction. The power tube has appropriately valved air inlets (one such inlet 98 is shown in FIG. 1A) which are coupled to the interior of power tube 2 at regular intervals and which are suitably remotely controlled and regulated to apply atmospheric or pressurized air to the inside of the power tube once the expanded blades 86 of the thrust valve have passed the inlet, to maintain the pressure differential across the frusto-conical valve wall 96 and continue generating the force that moves the thrust carriage forwardly.

Thrust valve 20 attached to aft thrust carriage 16 is constructed in the same manner as thrust valve 18 attached to the front carriage, but is oriented oppositely to the valve at the front carriage. As a result, the aft carriage, and the cabin and front carriage coupled thereto, can be moved in the opposite direction (to the right as seen in FIG. 4A) by retracting the piston rod at the front carriage and extending the piston rod of the actuator on the aft carriage until its blades engage the inside of the power tube.

A particular advantage attained with the thrust valve of the present invention is that the free ends 94 of the blades are resiliently flexible so that they can readily conform to surface and/or shape irregularities of the inside of the power tube without leading to appreciable leakages past the expanded blades. Additionally, during use, low-friction surface coatings, lubricants and the like can be applied to the inside surfaces of the power tube to reduce wear and friction between the tube and the expanded valve blades while maintaining a good seal to prevent undesired air leakage past them.

As mentioned, thrust carriages 14, 16 are coupled to cabin 6 with magnetic coupler 22. Magnetic elements 24 of the coupler attached to thrust carriages 14, 16 can be brought into close physical proximity to non-magnetic window strip 28 in power tube 2, because the interior rails 12 engaged by the V-grooved wheels 38, 40 of the power carriage provide highly accurate and dimensionally stable guidance for the thrust carriages so that the spacing or stand-off between the top surface of the magnetic element and the inside of the non-magnetic window strip can be kept small. This in turn enhances the effectiveness of the magnetic coupling to magnetic element 26 carried by the undercarriages 6, 8 of cabin 10.

Figure 8A:
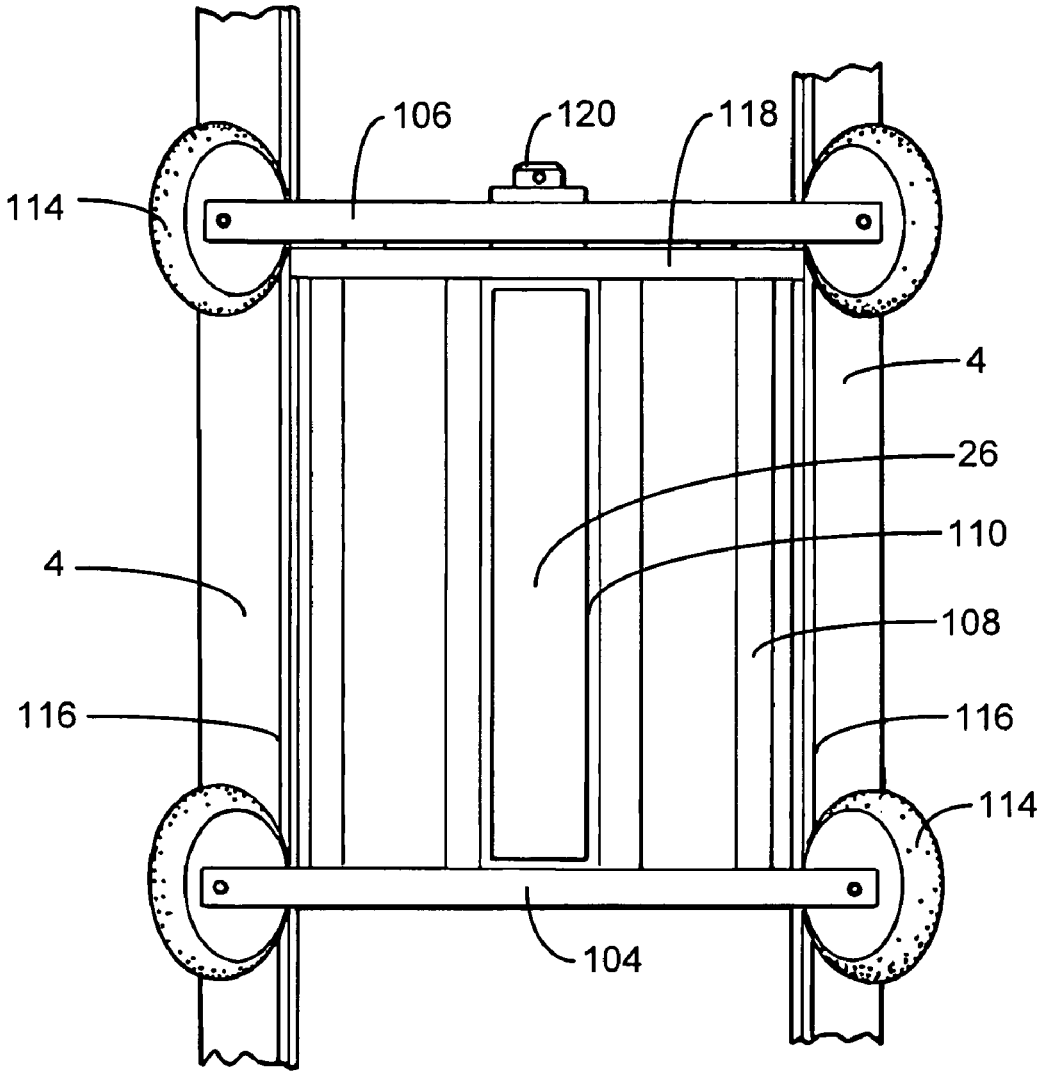
FIG. 8A is a plan view of an undercarriage for the vehicle which engages and runs along the exterior track shown in FIG. 7.
Figure 8B:
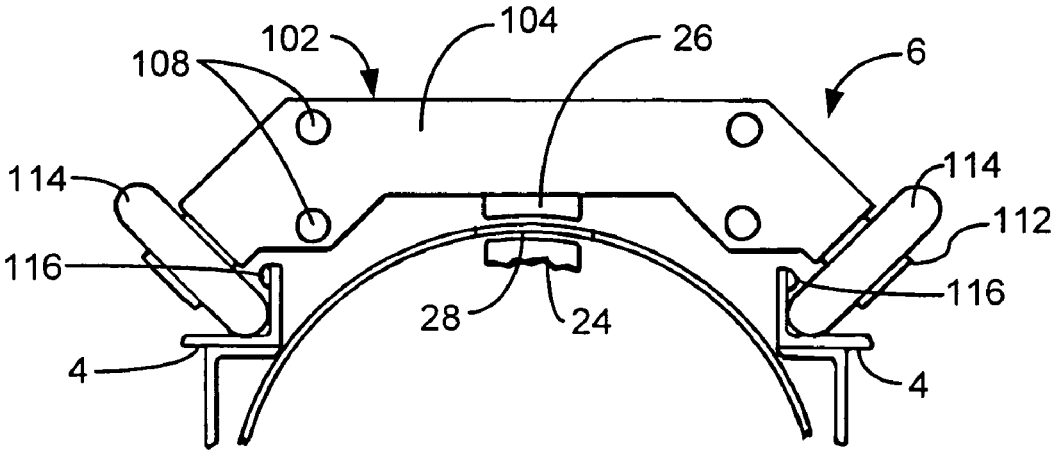
FIG. 8B is a fragmentary, front elevational view of an upper portion of a power tube and further illustrates the construction of the undercarriage for the vehicle and its support and guidance by the exterior tracks.

Referring to FIGS. 1, 7 and 8A, 8B, cabin 10 is carried by and runs on forward and aft undercarriages 6, 8 constructed of non-magnetic material, such as aluminum or titanium, for example, which are best shown in FIGS. 8A, 8B. Each undercarriage has a frame 102 defined by forward and aft end plates 104, 118 which are tied together with a plurality of tie rods 108. Aligned with the longitudinal center line of the carriage is a pocket 110 constructed of non-metallic material into which magnetic element 26 of the cabin is placed for positioning it closely adjacent the outer periphery of non-magnetic window strip 28 in power tube 2.

Shafts 112 (see FIG. 8B) protrude from each lateral end of the respective forward and aft end plates 104, 106 at an angle of 45° and rotatably mount cabin carrying and guiding wheels 114. The wheels are rotatable about axes inclined 45° from the horizontal, and their peripheries rest and engage the open side of angle tracks 4. A keeper bar 116, which may be attached to the upright leg of the angle tracks, or can be integrally formed therewith, keeps the wheels in their inclined position in the tracks and prevents them from rising in the track. In other words, the keeper bars assure that the wheels remain at all times properly positioned on the angle tracks. Since the wheels only support and guide the cabin, but are not needed to propel the cabin along the power tube, they can be constructed to minimize friction. In a preferred embodiment, the wheel peripheries are rounded so that they simultaneously engage a portion of the surface of each leg of the angle tracks.

This has a number of advantages. Unlike wheels for ordinary rail cars, they need not be flanged. Moreover, the relative speed between the peripheral portions of the wheel in contact with the respective legs of the angle tracks is the same, which eliminates all but rolling friction. Friction, wear and noise generated by the wheels, particularly when negotiating curves, are low, particularly when compared to noise, friction and wear encountered with conventional flanged rail car wheels. In addition, the wheels can be constructed of a variety of materials, including metals, plastics and even pneumatic tires. Moreover, the wheels are equally effective when traveling along straight sections of the power tube or when negotiating curves. Finally, if desired, instead of wheels, the undercarriage can be supported on low-friction sliding shoes (not shown) which slidably engage the track.

In the preferred embodiment of the invention, one of the set of wheels 114, e.g. the ones carried by end plate 106, can be pivotally attached to mounting plate 118 (see FIG. 8A) with a suitable pivot connection 120. The resulting articulation enables all wheels to stay in track contact during planar changes of the individual rails (e.g. when entering a banked section of the rails) or other dimensional and/or shape irregularities in the rails.

Undercarriages 6, 8 are in turn suitably connected to cabin 10 in a manner that is well known in the art and, therefore, is not further described herein. Needless to say, the connection between the undercarriages and the cabin is such that some relative pivotal motion between the undercarriages and the cabin is possible for negotiating curves, particularly sharp curves with a relatively small radius.

Turning now to the overall operation of the improved elevated rail system of the present invention, a complete transportation module is assembled by attaching to the under side of cabin 10 forward and aft undercarriages 6, 8 in the manner described above. The cabin, including the carriages, can be lifted and placed in operative position by engaging the angle tracks 4 with undercarriage wheels 114 so that the wheels support the carriage and permit it to travel along the angle tracks. Since the angle tracks are carried by support structure 48 for the power tube, and do not apply a load to the power tube itself, the power tube can be of relatively lighter construction because it does not have to carry the payload. Moreover, the power tube will not undergo deformation when a cabin passes over it due to the weight of the latter. As a result, the power tube will substantially retain its cross-sectional shape and dimension, typically a circularly round shape, although other cross-sectional shapes for the tube can be selected should that be desirable.

At least two power carriages 14, 16 will next be inserted into the interior of the power tube, for example through an open-ended installation tube (not shown in the drawings), by engaging the round interior rails 12 with the V-grooved wheels 38, 40 of thrust carriages 14, 16. The thrust carriages are aligned with the cabin on the exterior of the power tube so that the respective magnetic elements 24, 26 on the thrust carriages and the cabin are in mutual alignment. It is presently preferred to use permanent magnets for magnetic elements 24, 26 for both weight and space savings due to the magnets' high strength. However, if desired, electromagnetic elements can be used. In such an event, electric cables and controls for supplying current to the magnetic elements and controlling the current flow are installed and connected as is well known to those skilled in the art. In any event, the thrust carriages 14, 16 become magnetically locked and secured to the undercarriages 6, 8 of cabin 10.

Next, the relative spacing between magnetic elements 24, 26 and non-magnetic window strip 28 in power tube 2 is adjusted by raising and lowering, respectively, the elements with suitable adjustment devices (not shown) so that their surfaces facing the power tube are as close as possible to the non-magnetic window without actually touching it. Since the power tube is not subject to deformation due to the weight of the passing cabin, and the power carriages 14, 16 are accurately guided along interior tracks 12 by the V-grooved wheels of the power carriages, the anticipated variations in the actual spacing between the magnetic elements and the non-magnetic window strip will be small. As a result, the adjusted spacing between the magnetic surfaces and the non-magnetic window of the power tube can be held small, typically in the vicinity of no more than a few millimeters, to enhance the efficiency of the magnetic couplings.

To move the transportation module forward (or aft), pressurized air from source 32 is introduced into the power tube via inlet 98. The thrust valve located on the carriage facing in the desired direction of movement is expanded by energizing the associated hydraulic actuator 62 to open valve blade 86 until their ends touch the inner surface of the power tube. As a result, pressure builds up on the concave side of the opened thrust valve, which generates thrust in a forward direction, causing the valve and therewith the thrust carriage attached thereto to move in a forward direction. This forward movement of the thrust carriage is transmitted to cabin 10 via magnetic coupler 22. Accordingly, the entire transportation module begins to move in a forward direction.

Maximum thrust and/or the speed of the power carriage is attained when the thrust valve is fully open and forms wall 30, 96. If desired, thrust can be increased by increasing the pressure of the air from source 32 via suitable valves and controls which are not separately described herein. In a preferred embodiment, greater thrust is generated by increasing the vacuum generated by source 34 ahead of the thrust valve to increase the pressure differential between the concave and convex sides of the valve.

To reduce the speed or thrust generated by the power valve, the air pressure from source 32 can be reduced. Preferably, however, thrust is reduced much more rapidly by partially retracting the extended thrust valve by correspondingly energizing the hydraulic actuator 62 to partially retract piston rod 64 and thereby form an unobstructed bypass channel 97 between the valve blades 86 and the interior surface of power tube 2, which in turn reduces the thrust generated by the valve and the force and speed with which the power module is moved forwardly.

For more rapid deceleration or for stopping movement of the transportation module, the forward thrust valve 10 can be opened; that is, its blades 86 can be retracted into cup 70 as earlier described to end the forward thrust. At the same time, thrust valve 20 of the aft thrust carriage 16 can be expanded. This generates a thrust in a direction opposite to the direction of movement of the transportation module, which will enhance the braking action and can be used to bring the transportation to a quick, complete stop.

Figure 5A:
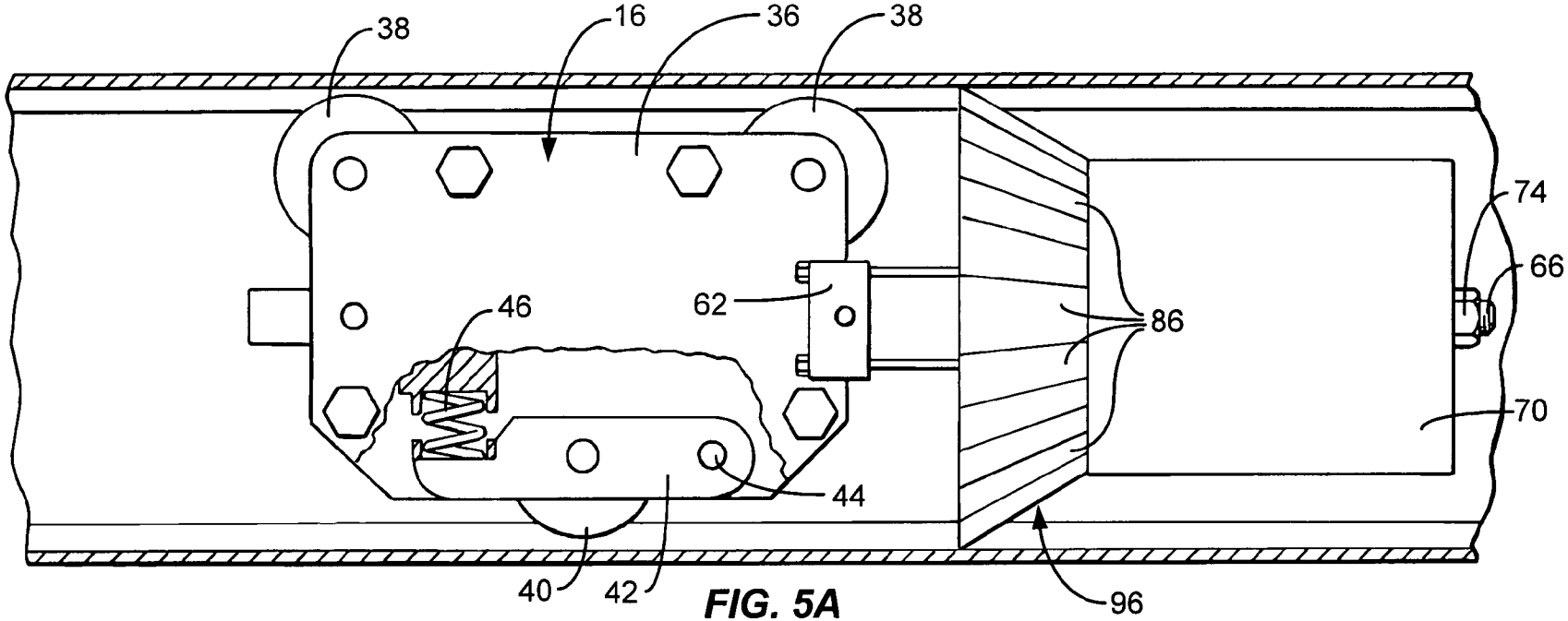
FIG. 5A is a cross-sectional plan view through the power tube and shows the propulsion unit that is guided along the interior rails of the power tube.
Figure 5B:
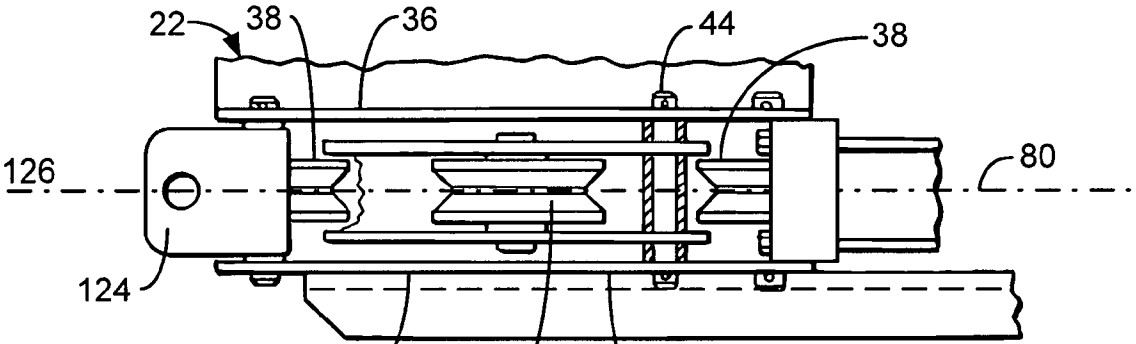
FIG. 5B is a side elevational view of the propulsion unit shown in FIG. 5A.
Figure 6:
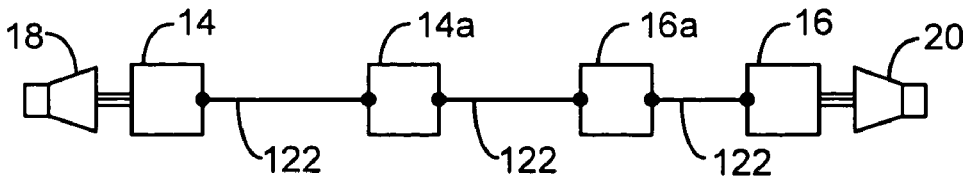
FIG. 6 schematically shows two propulsion units, effective in opposite travel directions, connected to additional carriages disposed inside the power tube for use with long and/or multi-sectional vehicles running along the power tube.
Figure 7:
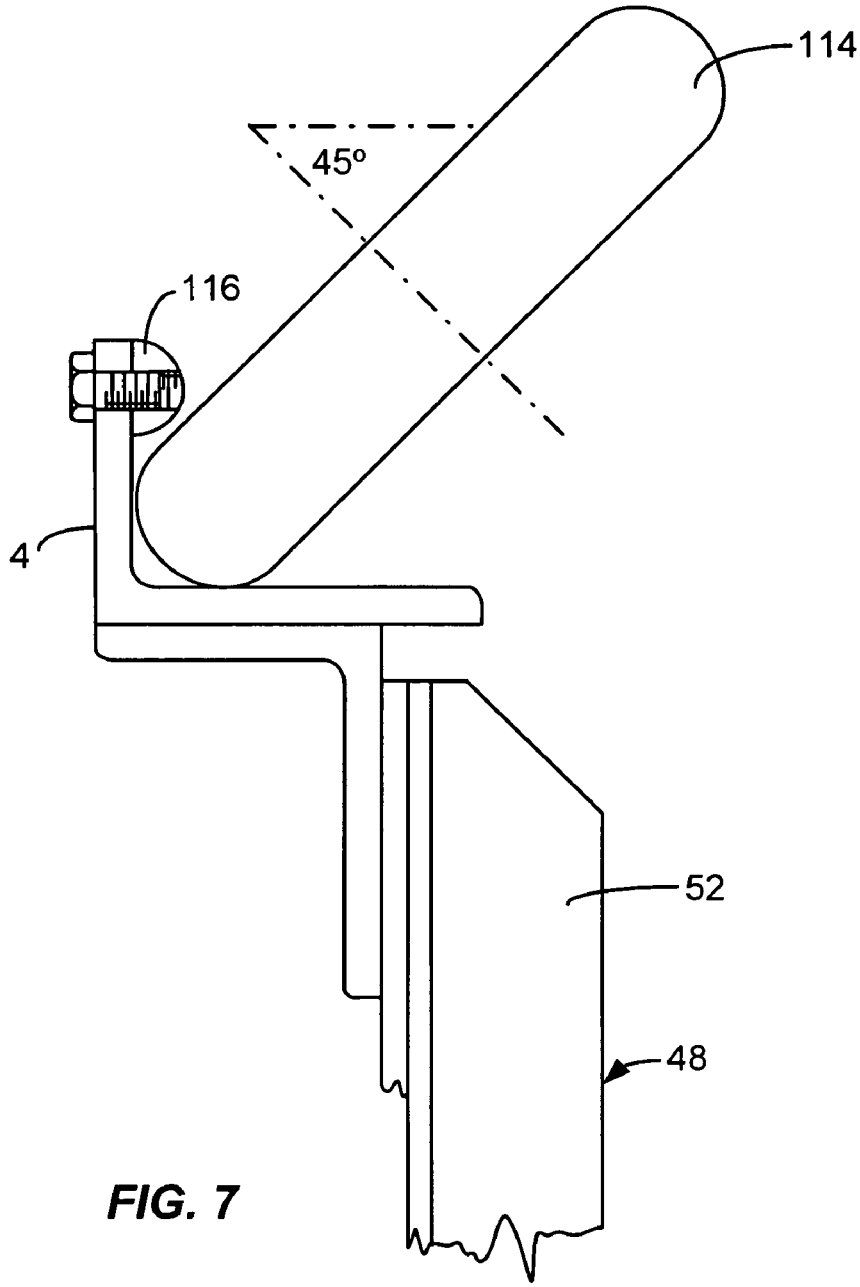
FIG. 7 is a fragmentary, cross-sectional view which shows the exterior track for guiding the vehicle.

Referring briefly to FIGS. 5A, 5B and 6, it is preferred that the thrust carriages be coupled to each other to maintain constant spacing between them and relative to the undercarriages 6, 8 of cabin 10. This can be accomplished by serially connecting the thrust carriages with tie rods 122. For that purpose, the carriages are provided with connecting plates 124, preferably attached to plates 36 of the thrust carriages so that they can pivot about a horizontal axis, and provided with bores 126 which are engaged by the tie rods.

In addition, multiple vehicles 12 (passenger cabins and/or cargo wagons) can be coupled to the front and rear vehicles provided with propulsion units. In such an arrangement, the vehicles between the front and rear vehicles need not have propulsion units and may comprise vehicles with only the earlier described undercarriages for supporting and guiding them and coupling carriages inside the power tube for attaching the tie rods, which are in turn magnetically coupled to their associated vehicles in the manner describe above.

What is claimed is:

1. A propulsion unit for moving a vehicle along an elongated power tube having an interior adapted to be selectively pressurized and an exterior along which a vehicle travels, the propulsion unit comprising first and second, diametrically opposed interior rails attached to an interior of the power tube, and a thrust carriage comprising a main body arranged between the first and second rails, first and second wheels rotatably mounted to a first side of the body proximate the first rail, at least a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a coupler for coupling the thrust assembly to the vehicle, a support frame supporting the power tube on the ground and including spaced-apart uprights disposed proximate an exterior of the power tube, and fasteners securing the first and second rails to the uprights of the support so that the weight of the propulsion unit is carried by the uprights without subjecting the power tube to stress.

2. A propulsion unit according to claim 1 wherein the first and second rails are disposed in a horizontal center plane of the power tube.

3. A propulsion unit according to claim 1 wherein the device comprises a spring.

4. A collapsible thrust valve for use with a thrust carriage for a vehicle adapted to travel along an elongated power tube subjected to thrust generating pressure differentials along its length, the thrust carriage being supported on an interior of the power tube and engaging interior tracks for moving the thrust carriage along the interior of the power tube, the thrust valve being adapted to be secured to the thrust carriage and comprising a collapsible, frusto-conically shaped wall formed by a multiplicity of overlapping, angularly inclined blades formed to be concentrically disposed in the power tube, and an actuator operatively coupled to the blades for selectively increasing an angle of the blades until free ends thereof contact an interior surface of the power tube to thereby prevent the flow of air through the tube past the wall and for retracting the blades so that the free ends thereof are spaced apart from the interior surface of the power tube, the valve generating a force acting in the longitudinal direction of the power tube when the free ends of the valve blades engage the interior surface and generating substantially one of a reduced force and no force when the valve blades are spaced from the interior wall.

5. A valve according to claim 4 wherein each blade comprises a resilient frame and an air-impervious covering attached to and extending over a major portion of the frame.

6. A valve according to claim 5 wherein the frame is a resilient metal wire frame and the covering is a plastic sheet.

7. The combination, comprising a track, a vehicle carried and guided by the track and having wheels with axes of rotation that are inclined relative to a horizontal plane, an elongated power tube for pneumatically generating a force for moving the vehicle along the power tube, and an exterior support structure for supporting the power tube above ground, the track comprising first and second rails arranged substantially parallel to the tube and secured to the support structure so that the weight of the vehicle supported and guided by the first and second rails is carried by the support structure and does not cause stresses in and a deformation of the power tube, the first and second rails having a substantially right-angle cross-section formed by first and second, substantially perpendicular legs, included right angles between the legs of the rails facing laterally relative to the track in opposite directions for simultaneously engaging the wheels with both legs of the rails.

8. The combination of claim 7 wherein at least one of the legs of each rail includes a keeper rail projecting from a surface of the one leg for preventing wheels of the vehicle from becoming disengaged from the tracks.

9. The combination of claim 8 wherein included right angles between the legs of the rails face laterally away from the power tube.

10. Apparatus for propelling a vehicle along a pneumatic power tube comprising an exterior support structure for supporting the power tube above ground, first and second angles each having first and second legs defining support and guidance tracks for the vehicle, extending parallel to the power tube, and supported by the support structure, first and second undercarriages secured to the vehicle including vehicle support and guidance wheels which are rotatable about axes inclined relative to the first and second legs of the angle tracks and which have a periphery that simultaneously engages the legs of the angle tracks so that the weight of the vehicle is supported by the angle tracks and the support structure only and the angle tracks guide the vehicle parallel to the power tube, a pneumatic propulsion unit movably disposed inside the power tube and guided so that it travels along the power tube, and a magnetic coupler having first and second cooperating magnetic elements attached to the vehicle and the propulsion unit, respectively, in operative alignment with each other, and wherein a portion of the power tube located between the magnetic elements is constructed of a non-magnetic material and extends over the length of the power tube.

11. Apparatus according to claim 10 wherein one of the legs is vertically disposed, an inclined angle between the legs of the tracks is 90° and faces in opposite directions away from the power tube, and wherein the wheels rotate about an axis inclined 45° relative to the legs of the tracks.

12. Apparatus according to claim 10 wherein the wheels have a generally round periphery engaging the legs of the angle tracks.

13. Apparatus according to claim 12 including a protrusion on the vertical legs shaped and arranged to prevent the wheels from rising upwardly relative to the vertical leg.

14. Apparatus for propelling a vehicle along a pneumatic power tube comprising an exterior support structure for supporting the power tube above ground, first and second angles defining support and guidance tracks for the vehicle, extending parallel to the power tube, and supported by the support structure, first and second undercarriages secured to the vehicle including vehicle support and guidance wheels which are rotatable about axes inclined relative to legs of the angle tracks and which have a periphery that engages the legs of the angle tracks so that the weight of the vehicle is supported by the angle tracks and the support structure only and the angle tracks guide the vehicle parallel to the power tube, a pneumatic propulsion unit movably disposed inside the power tube that travels along the power tube, and a magnetic coupler having first and second cooperating magnetic elements attached to the vehicle and the propulsion unit, respectively, in operative alignment with each other, a portion of the power tube located between the magnetic elements being constructed of a non-magnetic material and extending over the length of the power tube, first and second, diametrically opposed interior rails attached to an interior of the power tube, the propulsion unit including a thrust carriage comprising a main body arranged between the first and second rails, first and second wheels rotatably mounted to a first side of the body proximate the first rail, a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a collapsible thrust valve coupled to the thrust carriage comprising a collapsible, frusto-conically shaped wall formed by a multiplicity of overlapping, angularly inclined blades formed to be concentrically disposed in the power tube, and an actuator operatively coupled to the blades for selectively increasing an angle of the blades until free ends thereof contact an interior surface of the power tube to thereby prevent the flow of air through the tube past the wall and for retracting the blades so that the free ends thereof are spaced apart from the interior surface of the power tube, the valve generating a force acting in the longitudinal direction of the power tube when the free ends of the valve blades engage the interior surface and generating substantially one of a reduced force and no force when the valve blades are spaced from the interior wall.

15. A propulsion unit for moving a vehicle along an elongated power tube having an interior adapted to be selectively pressurized and an exterior along which a vehicle travels, the propulsion unit comprising first and second, diametrically opposed interior rails attached to an interior of the power tube, and a thrust carriage comprising a main body arranged between the first and second rails, first and second wheels rotatably mounted to a first side of the body proximate the first rail, at least a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a coupler for coupling the thrust assembly to the vehicle, a portion of the first and second interior rails extending into the grooved peripheries of the wheels has a substantially circularly round cross-section.

16. A propulsion unit for moving a vehicle along an elongated power tube having an interior adapted to be selectively pressurized and an exterior along which a vehicle travels, the propulsion unit comprising first and second, diametrically opposed interior rails attached to an interior of the power tube, and a thrust carriage comprising a main body arranged between the first and second rails, first and second wheels rotatably mounted to a first side of the body proximate the first rail, at least a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a coupler for coupling the thrust assembly to the vehicle, wherein the first and second wheels are located proximate longitudinal ends of the body and the third wheel is disposed about midway between the first and second wheels in a longitudinal direction of the body.

17. A propulsion unit for moving a vehicle along an elongated power tube having an interior adapted to be selectively pressurized and an exterior along which a vehicle travels, the propulsion unit comprising first and second, diametrically opposed interior rails attached to an interior of the power tube, and a thrust carriage comprising a main body arranged between the first and second rails, first and second wheels rotatably mounted to a first side of the body proximate the first rail, at least a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a coupler for coupling the thrust assembly to the vehicle, wherein the third wheel is mounted on an arm having a first end pivotally attached to the body and a second end engaged by the device so that the device urges the arm toward and the third wheel into engagement with the second rail.

18. A propulsion unit for moving a vehicle along an elongated power tube having an interior adapted to be selectively pressurized and an exterior along which a vehicle travels, the propulsion unit comprising first and second, diametrically opposed interior rails attached to an interior of the power tube, and a thrust carriage comprising a main body arranged between the first and second rails, first and second wheels rotatably mounted to a first side of the body proximate the first rail, at least a third wheel rotatably mounted to the body on a second side of the body proximate the second rail, a device for resiliently biasing the third wheel towards the second rail, the wheels having a grooved periphery shaped so that the first rail extends into the grooved periphery of the first and second wheels and the second rail extends into the grooved periphery of the third wheel as a result of a biasing force generated by the device, and a coupler for coupling the thrust assembly to the vehicle, wherein a collapsible thrust, valve attached to a longitudinal end of the body, the thrust valve having valve blades which are angularly inclined relative to the length of the power tube and which are expandable so that free ends of the blades engage an inside surface of the power tube and a pressure differential between front and aft sides of the blades generates a force which moves the valve and the thrust carriage attached thereto along the interior rails in a longitudinal direction of the power tube.

* * * * *